United States Patent [19]

Stimpson

[11] Patent Number: 4,975,985

[45] Date of Patent: Dec. 11, 1990

[54] NOVELTY CLOTHING

[76] Inventor: Cynthia C. Stimpson, Box 25365, Seattle, Wash. 98125-2265

[21] Appl. No.: 440,581

[22] Filed: Nov. 17, 1989

[51] Int. Cl.[5] ..... A41B 1/00; A41B 1/18; A41D 27/08

[52] U.S. Cl. ..... 2/115; 2/80; 2/90; 2/106; 2/DIG. 7; 446/28

[58] Field of Search ..... 2/49 R, 75, 80, 90, 2/105, 106, 113, 114, 115; 446/26, 28

[56] References Cited

U.S. PATENT DOCUMENTS

| | | | |
|---|---|---|---|
| 2,636,176 | 4/1953 | Ross | 2/93 |
| 3,443,066 | 5/1969 | Weibel | 2/69.5 |
| 3,523,302 | 8/1970 | Rabedeaux | 2/69.5 |
| 4,058,853 | 11/1977 | Boxer et al. | 2/DIG. 6 |
| 4,089,067 | 5/1978 | Velasco | 2/115 |
| 4,165,555 | 8/1979 | Boxer et al. | 2/DIG. 6 |
| 4,249,268 | 2/1981 | Berler | 2/115 |
| 4,253,197 | 3/1981 | Posta | 2/115 X |
| 4,277,848 | 7/1981 | Boehland | 2/115 |
| 4,296,498 | 10/1981 | Vinson | 2/115 |
| 4,414,692 | 11/1983 | Dzierson et al. | 2/DIG. 6 |
| 4,535,479 | 8/1985 | Paula | 2/115 X |
| 4,627,110 | 12/1986 | Tengs | 2/115 X |
| 4,710,979 | 12/1987 | Bull et al. | 2/49 X |
| 4,754,500 | 7/1988 | Brucato et al. | 2/205 |
| 4,860,387 | 8/1989 | Williams | 2/49 X |

FOREIGN PATENT DOCUMENTS

| | | | |
|---|---|---|---|
| 88/02605 | 4/1988 | World Int. Prop. O. | 2/DIG. 6 |

*Primary Examiner*—Werner H. Schroeder
*Assistant Examiner*—Jeanette E. Chapman
*Attorney, Agent, or Firm*—Robert W. Jenny

[57] ABSTRACT

The invention comprises garments bearing indicia in turn comprising components of VELCRO ® such that when the indicia on two garments are brought into contact the garments adhere to each other. In a preferred embodiment the garments are provided in sets of two with the indicia on one garment in the set comprising the loop component of VELCRO ® and the indicia on the other comprising the hook component. In a second embodiment all indicia comprises both hook and loop components.

2 Claims, 1 Drawing Sheet

FIG. 1
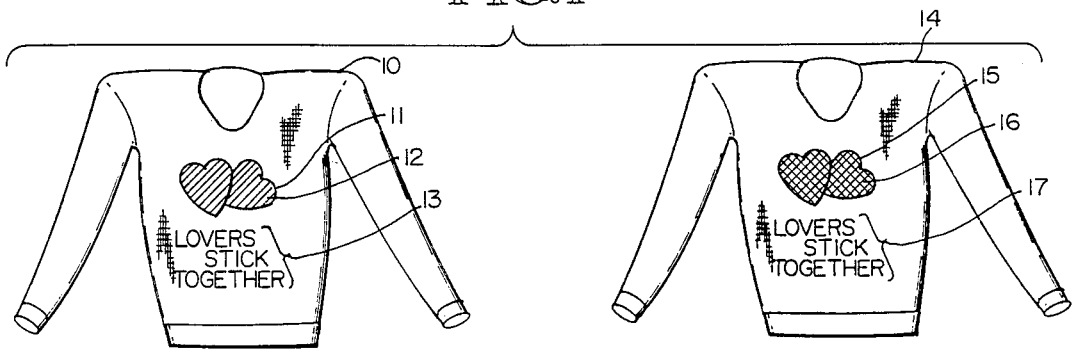
FIG. 2
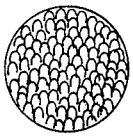
FIG. 3
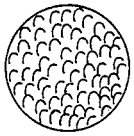
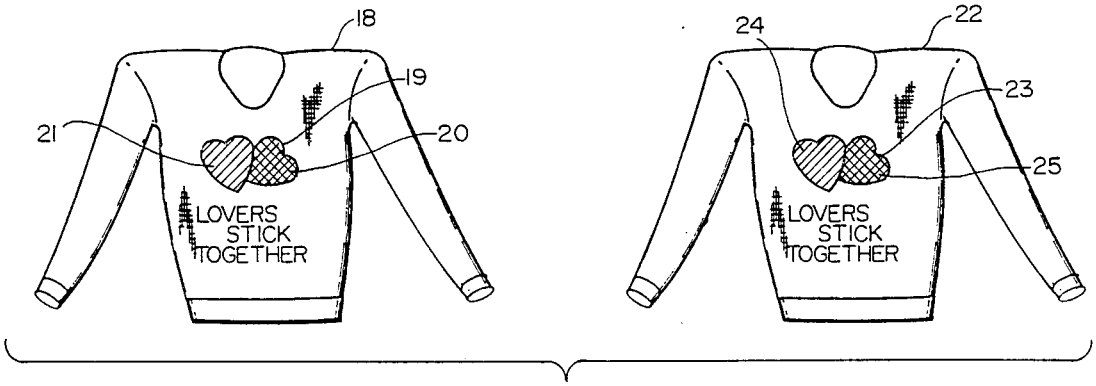
FIG. 4

NOVELTY CLOTHING

BACKGROUND OF THE INVENTION

Field:

The subject invention is in the field of clothing, particularly indicia bearing clothing such as T shirts, blouses, slacks, hats, gloves and the like. It is also in the field of clothing in which VELCRO ® is used to fasten one part of an article of clothing to another part providing, for example, closures for jackets and pockets, attachment of hoods to jackets and adjustable fastening for cuffs and footwear.

Prior Art:

There is much prior art in these fields. Indicia bearing clothing is well known in the art and VELCRO ® is in common use in many ways as a fastening means on garments, in each case serving a useful, functional purpose. The subject inventor has discovered a use for VELCRO ® components in which it serves its function as a fastening means but not in ways useful to the basic purposes of the garments. The objective of the subject invention, accordingly, is to provide garments comprising VELCRO ® components for novelty purposes not related to the basic purposes of the garments.

SUMMARY OF THE INVENTION

As is well known in the art, VELCRO ® is a fastening apparatus which comprises two clothlike components. One of the surfaces of one of the components is covered with small loops in close proximity to each other and essentially perpendicular to the surface. One of the surfaces of the other component is covered with small, flexible hooks in close proximity to each other and essentially perpendicular to the surface. For purposes of this disclosure the components are termed the loop component and the hook component. The invention is garments bearing indicia made, all or in part, from either the hook component or the loop component on any one garment or both components on either or both elements. In a preferred embodiment the garments are provided in sets of two with the garments identical except that on one of the two garments in a set the indicium is made from the hook component and on the other from the loop component. When the two garments are brought into contact in the areas of the indicia by the persons wearing them, the garments stick together until they are pulled apart. In a second embodiment the indicium or part of the indicia made from VELCRO ® on each garment comprises both hook and loop components. The first embodiment is preferred because of the cooperative, complementary aspect of use of the garments so made.

In one example of the invention the indicium on each garment comprise a heart shaped VELCRO ® component and silk screened wording stating: "Lovers Stick Together." In another example the VELCRO ® components might depict an athlete such as a runner or soccer player and the message reads "Athletes Stick Together." The VELCRO ® components may be attached at any area of a garment, areas covering the chest, shoulder or buttocks, for examples. Also, VELCRO ® components may be attached at more than one location on a garment, including locations inside the garment or in a pocket, and on both the front and back of a garment.

The invention is described in more detail below with reference to the attached drawings.

BRIEF DESCRIPTION OF THE DRAWINGS

FIG. 1 illustrates a set of garments incorporating a preferred embodiment of the subject invention.

FIG. 2 is an enlargement showing details of loop components, signified by regular crosshatching in FIGS. 1 and 4.

FIG. 3 is an enlargment showing details of hook components, signified by double crosshatching in FIGS. 1 and 4.

FIG. 4 illustrates a second embodiment of the invention.

DETAILED DESCRIPTION OF THE INVENTION

The subject invention comprises garments bearing indicia comprising VELCRO ® components such that when the components on two garments are brought into contact the garments stick together. In a preferred embodiment the garments comprise sets of two in which the indicium on one garment comprises only the hook component of VELCRO ® and the indicium on the other garment only the loop component. In a second embodiment the indicia on each garment comprises both VELCRO ® components.

The invention is illustrated in FIG. 1, a representation of a set (of garments in the preferred embodiment.) Garment 10 bears indicium 11 comprising a hook component 12 of VELCRO ® and a lettered message 13. Garment 14 bears indicium 15 comprising a loop component 16 of VELCRO ® and a lettered message 17. In use, when the garments are brought into contact such that component 12 engages component 16 the garments stick together.

FIG. 2 is an enlargement showing details of the loop components, signified by regular crosshatching in FIGS. 1 and 4. FIG. 3 is an enlargement showing details of the hook components, signified by double crosshatching in FIGS. 1 and 4.

FIG. 4 illustrates a second embodiment of the invention in which garment 18 bears indicia 19 comprising a hook component 20 of VELCRO ® and a loop component 21. Garment 22 is similar to garment 18 but the indicia 23 is a mirror image of that on garment 18 and component 24 is a loop component and component 25 is a hook component.

It is considered that it can be understood from this description that the invention meets its objective. It provides garments comprising VELCRO ® components for novelty purposes not related to the basic purposes of the garments. The VELCRO ® components do not add to the functional utility of the garments but do provide a novelty use.

It is considered that it will also be understood that, while certain embodiments of the invention are described herein, other embodiments and modifications of those described are possible within the scope of the invention which is limited only by the attached claims.

I claim:

1. A set of garments comprising a first garment to be worn by a first person and a second garment to be worn by a second person, said first garment bearing at least one indicium, said indicium on said first garment comprising at least one component of fastening apparatus which comprises hook and loop components, said second garment bearing at least one indicium, said indicium on said second garment comprising at least one component of fastening apparatus which comprises hook and loop components, said fastening apparatus components of said indicia being selected to be complementary, whereby when said indicium on said first garment is brought in contact with said indicium on said second garment by said first and second persons, said first and second garments become fastened together.

2. The set of garments of claim 1 in which each of said first and second garments bears at least one indicium comprising both components of fastening apparatus which comprises hook and loop components.

* * * * *